United States Patent [19]

MacPherson

[11] Patent Number: 4,572,153

[45] Date of Patent: Feb. 25, 1986

[54] COMPOUND BOW DRAW POSITION INDICATING DEVICE

[76] Inventor: Donald H. MacPherson, 675 Ocean Ave., West End, N.J. 07740

[21] Appl. No.: 428,200

[22] Filed: Sep. 29, 1982

[51] Int. Cl.[4] ..... F41B 5/00

[52] U.S. Cl. ..... 124/88; 124/24 R; 340/815.01

[58] Field of Search ..... 124/87, 23 R, 214 R, 124/88, DIG. 1, 90; 33/265, 241; 340/372

[56] References Cited

U.S. PATENT DOCUMENTS

| | | | |
|---|---|---|---|
| 3,450,122 | 6/1969 | Diamond | 124/87 X |
| 4,061,124 | 12/1977 | Groner | 124/88 X |
| 4,134,383 | 1/1979 | Flood | 124/87 X |
| 4,170,071 | 10/1979 | Mann et al. | 33/241 X |
| 4,179,613 | 12/1979 | Koren | 124/87 X |
| 4,195,414 | 4/1980 | Robinson | 33/241 X |
| 4,332,231 | 6/1982 | Napier et al. | 124/87 X |

*Primary Examiner*—Richard J. Apley
*Assistant Examiner*—William R. Browne

[57] ABSTRACT

A device is mounted to the sighting area of a compound bow for signaling when the bow drawstring has moved to a predetermined position. The device is hollow and serves to maintain the compound cables away from the line of travel of the bowstring. Electrical contacts are mounted within the hollow device and enable a signal when tripped by the movement of the cables.

9 Claims, 5 Drawing Figures

COMPOUND BOW DRAW POSITION INDICATING DEVICE

BACKGROUND OF THE INVENTION

This invention relates to archery and more particularly to a drawstring positioning indicator.

In archery, it is desirable for the archer to have an illuminated sight. To this end, many arrangements have been designed whereby the archer turns on a light within the sight by manual manipulation of a switch. This arrangement suffers from the basic problem that battery life is limited since the light is on for relatively long periods of time.

It is also a desirable feature to have an audible or visual indication when the drawstring has been extended to the proper position. In this regard some systems are available whereby a mechanical click is generated when the drawstring reaches a certain extension. This arrangement suffers from the problem that it must be reset after each click and thus if the string is over extended the archer must release the drawstring and start over.

Thus it is desirable to provide an arrangement which solves these problems and which is automatically operated.

SUMMARY OF THE INVENTION

I have designed a drawstring position monitoring system in a manner to achieve both of the above-discussed problems. My system has the advantage that it is easy to adapt to existing compound curve bows and is light in weight and fully adjustable. On compound bows the cable wires which reduce the draw tension travel away from the bow as the archer pulls back on the drawstring. Typically, these cables are held away from the arrow by a cable guard. I have modified the cable guard in a manner such that as the cables retreat from their quiescent position they trip a switch mounted in the cable guide. This switch is adjustable so that it is at a position which coincides with the desired bowstring draw. Operation of the switch turns on an LED mounted inside the sight. Thus, when the light within the sight is illuminated the archer knows that the string is at the proper position. Once this position has been attained the archer may track the target and if the tension changes, either by pulling the string further or by releasing the string slightly, the light will go out. The archer may then reposition the drawstring without completely releasing pressure.

Since the light is only on for a small period of time battery life is conserved.

DESCRIPTION OF THE DRAWING

The invention and its several other objects and features and advantages will be more fully understood from a reading of the following description to one embodiment taken in conjunction with the drawing in which.

DETAILED DESCRIPTION

Figure 1:
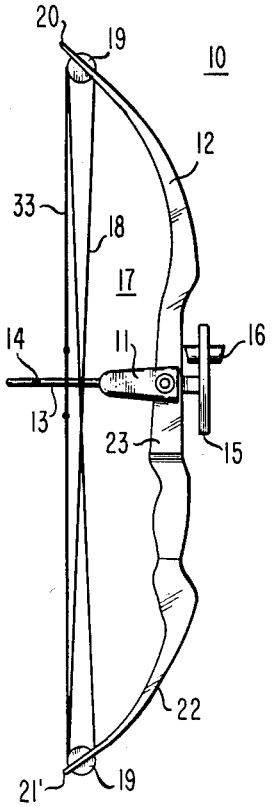
FIG. 1 shows an typical compound bow to which the invention can be attached.

In FIG. 1 there is shown a typical compound bow 10 having handle or riser 23, upper limb 12, upper nock 20, lower limb 22 and lower nock 21. Connected to bow near upper nock 20 and lower nock 21 are cams 19 having compound cables 18 connected therebetween. Each cable has one of its ends fastened to a cam and stretched around the other cam, the free end then being connected to drawstring 33. The purpose of the cams and the cables is to control the forces on the arrow (not shown) in a manner so that as the drawstring is pulled away from the handle the cams rotate causing the tension on the drawstring to be other than linear along its draw length.

For example, in a typical compound bow when the arrow is drawn to the proper distance, as measured from the riser, the bowstring might have a force on it of 25 pounds. As the arrow is released and the upper and lower limbs straighten, the cams rotate to cause the force of the arrow to suddenly increase to, say 50 pounds.

Figure 2:
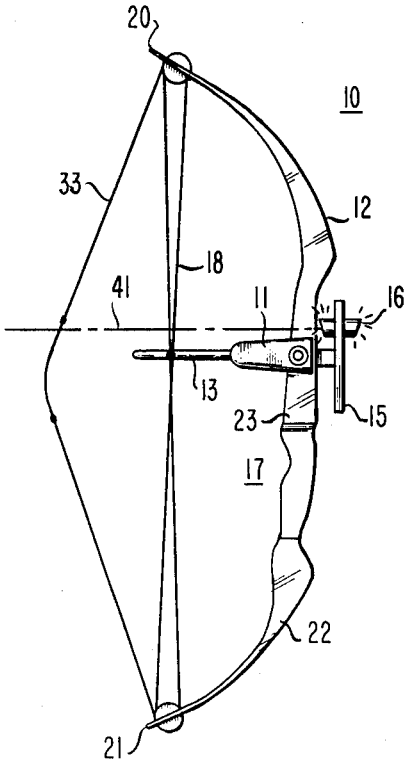
FIG. 2 shows the same bow with the bowstring drawn back.

As the arrow is drawn away from riser 23 the upper and lower limbs flex in the direction of the pull on the drawstring. This motion of the bending bow causes compound cables 18 to travel backward (to the left in FIG. 2) along with the draw of bowstring 33. FIG. 2 shows the drawstring pulled back to full draw position and cables 18 moved to the left following the bending of bow 10. If nothing more were to be done, the arrow feathers would become entangled on the cables. This problem is prevented by positioning a rod, such as rod 13, between the bowstring 33 and cables 18. Rod 13 is held in position by bracket 11 affixed to handle 23.

Mounted to handle 23 is bracket 15 to which is attached sight 16. Inside sight 16, shown in more detail in FIG. 3, is a light source, such as LED 34.

Mounted along rod 13 is a switch 14 positioned at a place such that when the bowstring 33 is draw back to the proper draw length, cables 18 will come into contact with switch 14 causing the switch to close. The closed switch will then turn on LED 34 within sight 16. This situation is shown in FIG. 2.

If bowstring 33 were to be drawn back further cables 18 would pass beyond switch 14 causing the switch to again open, turning the LED off. In this manner an archer, sighting along line 41 through sight 16 can immediately determine when the drawstring has reached the proper draw position by the illumination of the LED. If the archer inadvertently draws the arrow back further the LED would extinguish and the archer, without taking his eye from the sight can reposition the drawstring to the proper predetermined position. In this manner the archer will achieve a constant arrow velocity with each release of the drawstring.

Figure 3:
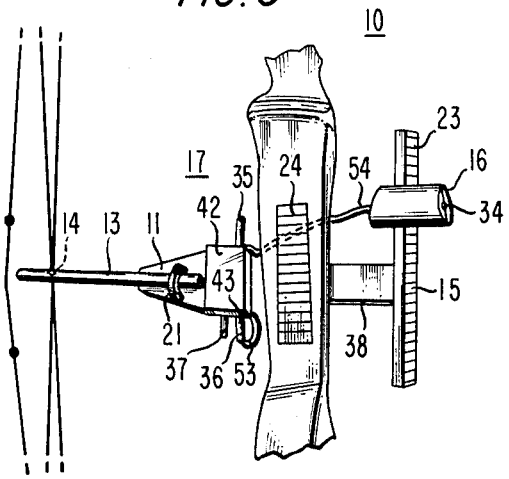
FIG. 3 is a close up view of the control arrangement.

As shown in FIG. 3, rod 13 is adjustable by clamp 21 so that switch 14 can be positioned any length from the handle. Also mounted to bracket 11 is box 43 which contains a battery 40 (FIG. 4), jack switches 35 and 36 and variable resistor 37. The resistor is used to control the brilliance of the of the LED while the jacks are used to insure that the LED is not accidentally turned on. Typically, the sight is removed from the bow either for storing or to change sights for different situations and the plug allows for such a situation. Thus, this device may be used interchangeably with any number of different sights.

Figure 4:
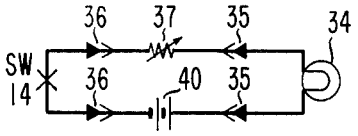
FIG. 4 is a schematic diagram of the circuitry involved.

As shown in FIG. 4, when switch 14 is closed current from battery 40 flows through resistor 37 to light LED 34.

Figure 5:
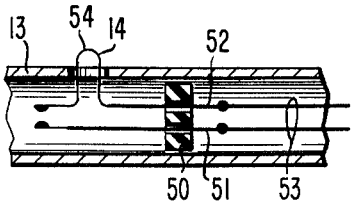
FIG. 5 shows details of one contact arrangement.

In FIG. 5 a cutout view of rod 13 is shown inside which switch 14 is fitted. Switch 14 consists of two contacts held apart by insulator 50. When cable 18 rides along rod 13 it contacts protrusion 54 of contact 52 forcing that contact downward against contact 51 thereby closing the circuit.

Of course, the leaf switch may be replaced with any type of switch operable by the cable. Also, more than one switch may be mounted to rod 13 so that the archer may have more than one indication of drawstring travel. One switch could operate the light while the other could sound an electronic sounder. There may be more than one LED mounted within the sight or one LED can have different colors as an indication of the draw travel.

It can be seen from the foregoing discussion that the LED is only on for the instant of time the archer requires the light giving an indication of drawstring travel thereby conserving the battery. Of course, while not shown, an audible sounding arrangement may be attached to the circuit to give an indication of drawstring length.

What I claim is:

1. A bow draw position indicating device for mounting to a compound bow, said bow having a bowstring between the nock ends of the bow riser and having compound cables between the upper and lower ends of said bow, said device comprising means for mounting said bow drawn positioning indicating means to said bow, means for maintaining said cables of a bow to which said device is mounted out of the line of travel of said bowstring of said bow to which said device is mounted when the bowstring is released from the drawn position, electrical contact means positioned along said maintaining means for providing a signal when closed, and cable positioning means on said positioning means adapted to close said electrical contact means only when said cables of a bow to which said device is mounted have moved to a certain preestablished point along said maintaining means.

2. The device set forth in claim 1 wherein said device includes a source of power, signaling means for indicating to a user that a bow cable is in a given draw position, and means for connecting said source of power to both said contact means and to said signaling means.

3. The device set forth in claim 2 wherein said signaling device is a light source.

4. The device set forth in claim 3 wherein said light source is an LED mounted within a sight.

5. The device set forth in claim 1 wherein said electrical contact means is mounted inside said device and wherein said cable positioning means is mounted partially inside said device and partially outside said device, the outside portion of said positioning means including means for monitoring the movement of said cables of a bow to which said device is mounted.

6. A bow draw position indicating device for mounting to a bow, said bow having nock ends between which a drawstring is supported, and having a sighting area substantially in the center of said bow between said nock ends, said bow having compound cables between the nock ends thereof, said cables arranged to move away from said bow sighting area in accordance with the draw movement of said drawstring, said device comprising positioning means extending from said bow when said device is attached to said bow at said sighting area for positioning said cables of a bow to which said device is mounted, said positioning means including means for monitoring the movement of said cables of said bow to which said device has been mounted, and means operative said monitoring means and controlled by the movement of said cables to said predetermined position along said positioning means for providing an indication when said drawstring of a bow to which said device has been mounted has been drawn to a certain predetermined position.

7. The device set forth in claim 6 wherein said device further includes a sight mountable on said bow and wherein said signal is a light signal within said sight.

8. The device set forth in claim 6 further comprising means for selectively varying said predetermined position.

9. The device set forth in claim 6 wherein said positioning means is hollow and wherein said indication providing means is an electrical contact mounted within said hollow positioning means and communicating with the outside of said positioning means.

* * * * *